US005452824A

United States Patent [19]

Danek et al.

[11] Patent Number: 5,452,824

[45] Date of Patent: Sep. 26, 1995

[54] METHOD AND APPARATUS FOR DISPENSING FLUID DOTS

[75] Inventors: John E. Danek, Vestal, N.Y.; Randy S. Cole, Brackney, Pa.

[73] Assignee: Universal Instruments Corporation, Binghamton, N.Y.

[21] Appl. No.: 359,600

[22] Filed: Dec. 20, 1994

[51] Int. Cl.[6] ..... B65D 88/54

[52] U.S. Cl. ..... 222/47; 222/263; 222/327; 222/334; 222/389

[58] Field of Search ..... 222/47, 61, 263, 222/327, 334, 389

[56] References Cited

U.S. PATENT DOCUMENTS

| | | | |
|---|---|---|---|
| 3,279,660 | 10/1966 | Collar | 222/389 X |
| 3,980,209 | 9/1976 | Colar | 222/334 X |
| 4,155,490 | 5/1979 | Glenn | 222/327 |
| 4,231,494 | 11/1980 | Greenwood | 222/389 X |
| 4,273,270 | 6/1981 | Kray | 222/327 |
| 4,426,024 | 1/1984 | Hogan et al. | 222/389 X |
| 4,572,103 | 2/1986 | Engel | 222/260 X |
| 4,634,027 | 1/1987 | Kanarvogel | 222/389 X |
| 4,635,827 | 1/1987 | Roedig | 222/389 X |
| 4,935,261 | 6/1990 | Srivastava et al. | 222/61 X |
| 4,986,444 | 1/1991 | Corso | 222/327 X |
| 5,029,731 | 7/1991 | Klatt | 222/389 X |

FOREIGN PATENT DOCUMENTS

| | | | |
|---|---|---|---|
| 0052060 | 10/1981 | European Pat. Off. | 222/389 |
| 2472176 | 6/1981 | France | 222/327 |

*Primary Examiner*—Andres Kashnikow
*Assistant Examiner*—Kenneth Bomberg
*Attorney, Agent, or Firm*—Banner & Allegretti, Ltd.

[57] ABSTRACT

A fluid dispensing station includes a pneumatic clamp for easy and secure mating and un-mating of a supply syringe to the dispensing nozzle from which dots of fluid are selectively dispensed according to displacement of a plunger of the syringe. A syringe cover seals the distal end of the syringe during mating and provides access of pressurized air to the sealed syringe in order to displace the plunger. The piston rod of a pneumatic cylinder protrudes through the cover and into the syringe and serves as a follower which is maintained in engagement with, and follows the displacement of, the syringe plunger. The follower may be used to supplement the primary plunger displacement force, which is supplied by the pressurized air applied to the clamped and sealed syringe via the cover, by applying air at the same or a different pressure to the piston of the follower cylinder. The follower also can be used in indicating a low level state of the adhesive to an attendant.

7 Claims, 2 Drawing Sheets

METHOD AND APPARATUS FOR DISPENSING FLUID DOTS

BACKGROUND OF THE INVENTION

The invention deals generally with automated populating of circuit boards with electrical components. More particularly, the invention is directed towards the placement of surface mounted components (SMC's) where a viscus fluid must first be placed on the board as part of the placement process.

Typically during the placement process, circuit boards are conveyed to each of a sequence of stations of an automated machine or string of automated machines, with a different part of the process being performed at each station. At the fluid dispensing station, the board is repositionable in X and Y relative to a fluid dispenser such as that described in U.S. Pat. No. 4,572,103 in order to place a dot, or a multiplicity of dots, of fluid on the board at each location on which a component subsequently is to be placed.

The size of each dot, as well as the quantity of fluid in each dot, needs to be consistent for each of a given type and/or size of components in order to insure in the case of a glue-like fluid that the component placed on the dot will be retained or in the case of the application of a fluid flux that the subsequent soldering process will be enhanced.

Also, the attendant of the fluid dispensing station needs to know how much fluid is in the syringe supplying fluid to the dispensing nozzle, as dispensing progress, in order to know when to replace an empty or nearly empty syringe with a full one so as to result in a minimum amount of downtime for any given process run.

Prior art mounting of the syringe of the dispensing nozzle involves manipulation and connection of a cover and integrally attached air hose to the distal (plunger) end of the syringe and subsequent threading of the "Luer lock", at the proximal (dispensing outlet) end of the syringe, onto the nozzle of the fluid dispensing station. These operations require considerable operator training, dexterity and results in unwanted loss of production during the machine downtime to perform these functions. Also the Luer lock is fragile and "strips out" if not threaded properly resulting in pressurized adhesive squirting out of the end of the syringe with considerable downtime for cleanup. In addition to requiring special attention and care in securing the syringe to the nozzle, difficulties in removing prior art covers have resulted from the bayonet-type connection, as well as from size variations in the connection portions of the distal ends of the syringes.

Thus, it is an object of the invention to overcome prior art deficiencies which cause difficulties in insuring a reliable connection of the syringe to the nozzle and in easily connection and disconnecting the cover of the distal end of the syringe.

In order to know when the supply of fluid is depleted sufficiently to need replacement, the prior art has involved (i) an attendant manually checking the level of fluid in the syringe, (ii) use of a capacitive sensor, or (iii) use of a n inductive sensor positioned on the outside of the syringe with a metal disk situated on the inside of the syringe and moveable to notify the sensor when the fluid supply is low.

Manually checking the level of fluid requires that the attendant stop the machine. Thus, checking the level during a run and/or running out of fluid in the middle of a run, rather than replacing syringes as needed between runs, can and does result in unnecessary and inefficient downtime in the automated processing of SMC's. Also, if the attendant does not have a constant indication of the amount of adhesive remaining in a syringe, there is wasted processing time between recognizing an empty syringe and replacing it with a refill.

Use of a capacitive sensor presents measurement inaccuracies due to characteristic changes in the sensor with temperature and/or humidity changes.

A disadvantage with inductive sensor/metal disc devices of the prior art is the additional requirement for moving the disc from an empty syringe to its full replacement, which can and has resulted in loss of the disc. Also, these prior art metal discs have gotten stuck in residual adhesive remaining on the inside wall of a syringe as adhesive is dispelled. This presents additional difficulties in removing the disc from the empty syringe and requiring cleaning of the disc or the expense of replacement with a new disc before use in the replacement syringe.

Thus, it is an object of the invention to provide for constant monitoring of the quantity of fluid which is available at the dot dispensing station, so that supply syringes can be replaced in a timely and efficient manner.

Additionally, it is an object of the invention to provide a reliable apparatus of monitoring the fluid available at the station for dispensing without requiring the attendant to retrieve, reposition and/or clean loose parts of the sensor mechanism.

Prior art devices apply pressurized air to the distal end of the syringe as the only motive force for moving the plunger and, in turn, the fluid within the syringe. Typically, an air hose connects the source of pressurized air to a removable cover for the distal end of the syringe. If the plunger gets "hung up" in the syringe, as sometimes occurs, it can become tilted or deformed so that the seal between the plunger and the inner surface of the syringe fails and pressurized air bypasses the plunger and aerates the fluid.

As a result of such aeration, the amount of fluid in the dots being dispensed becomes unreliable and, since air can take the place of at least some of the fluid of a dot being dispensed, cia result in unreliable attachment of the surface mounted electronic components (SMC's) to the circuit boards.

Accordingly, it is an object of the invention to minimize such "hang-ups" that cause breakage of the seal between plunger and syringe and the resulting degradation of the desired fluid dot by pressurized air.

The reader's attention is directed to the distinction which is made, throughout this disclosure, between the "piston" of an air cylinder and the "plunger" of a syringe-type adhesive supply.

BRIEF SUMMARY OF THE INVENTION

An adhesive dot dispensing station includes easy and secure mating and un-mating of the proximal end of a supply syringe to the dispensing nozzle from which dots of flue are selectively dispensed according to displacement of the plunger of the syringe. Also, a syringe cover which seals the distal end of the syringe during mating of the proximal end of the dispensing nozzle and provides access of pressurized air to the sealed syringe in order to displace the plunger. The piston rod of a pneumatic cylinder protrudes through the cover and into the syringe and serves as a follower which is maintained in engagement with, and follows the displacement of, the syringe plunger. The follower prevents tilting of the plunger about its central axis and thus prevents the air from leaking into and aerating the adhesive and resulting in unreliable glue dots. The follower may be used to supplement the primary plunger displacement force, which is supplied by the pressurized air applied to the clamped and sealed syringe via the cover, by applying air at the same or a different pressure to the piston of the follower cylinder. The follower can also be used to indicate a low level state of the adhesive in the syringe to an attendant.

The novel features which are considered to be characteristic of the invention are set forth in particular in the appended claims. However, the construction and method of operation of the invention, together with additional objectives and advantages thereof, will be understood better from the remaining disclosure when read in conjunction with the accompanying drawings.

DETAILED DESCRIPTION OF THE INVENTION

Figure 1:
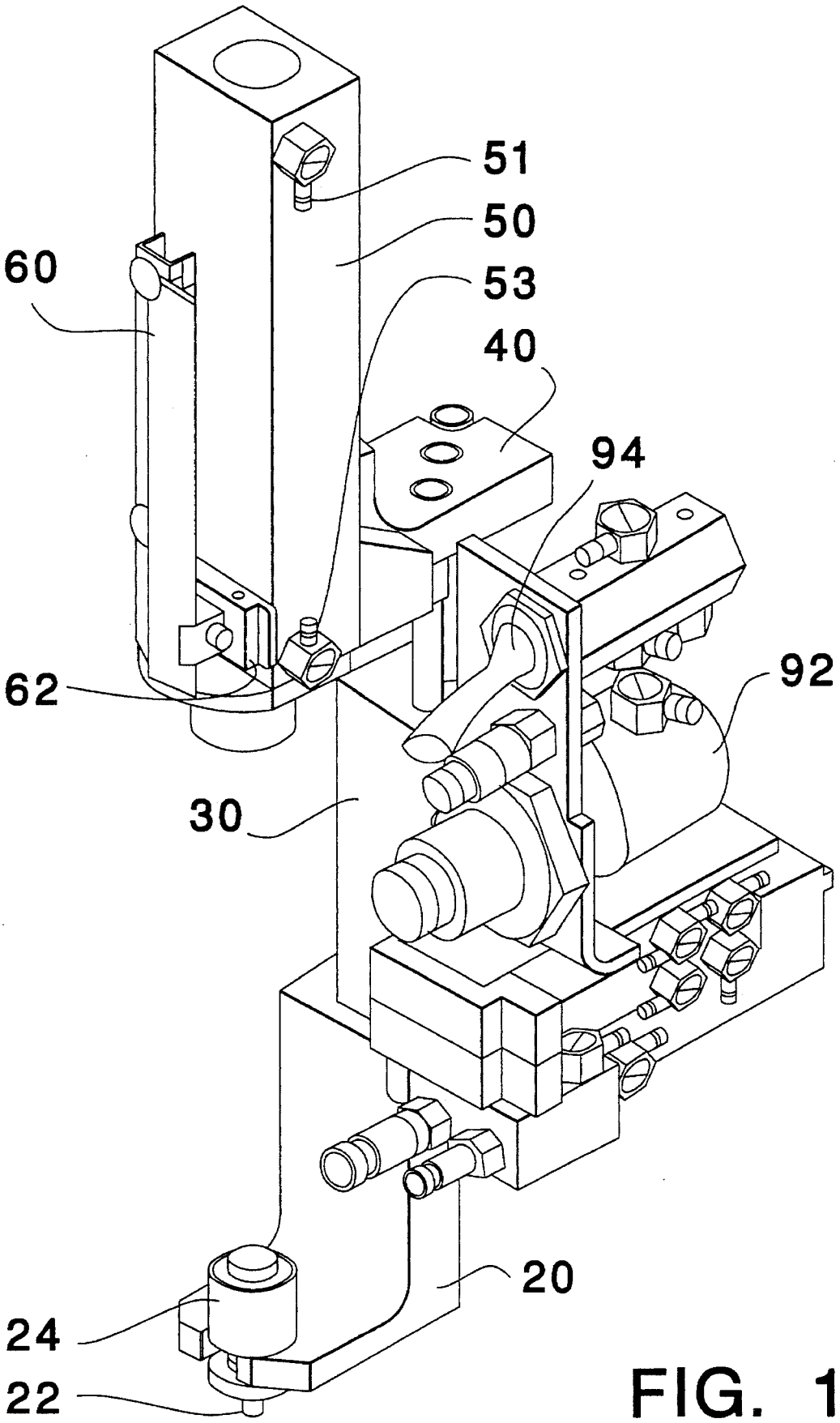
FIG. 1 is an isometric view of the instant invention without the syringe.
Figure 2:
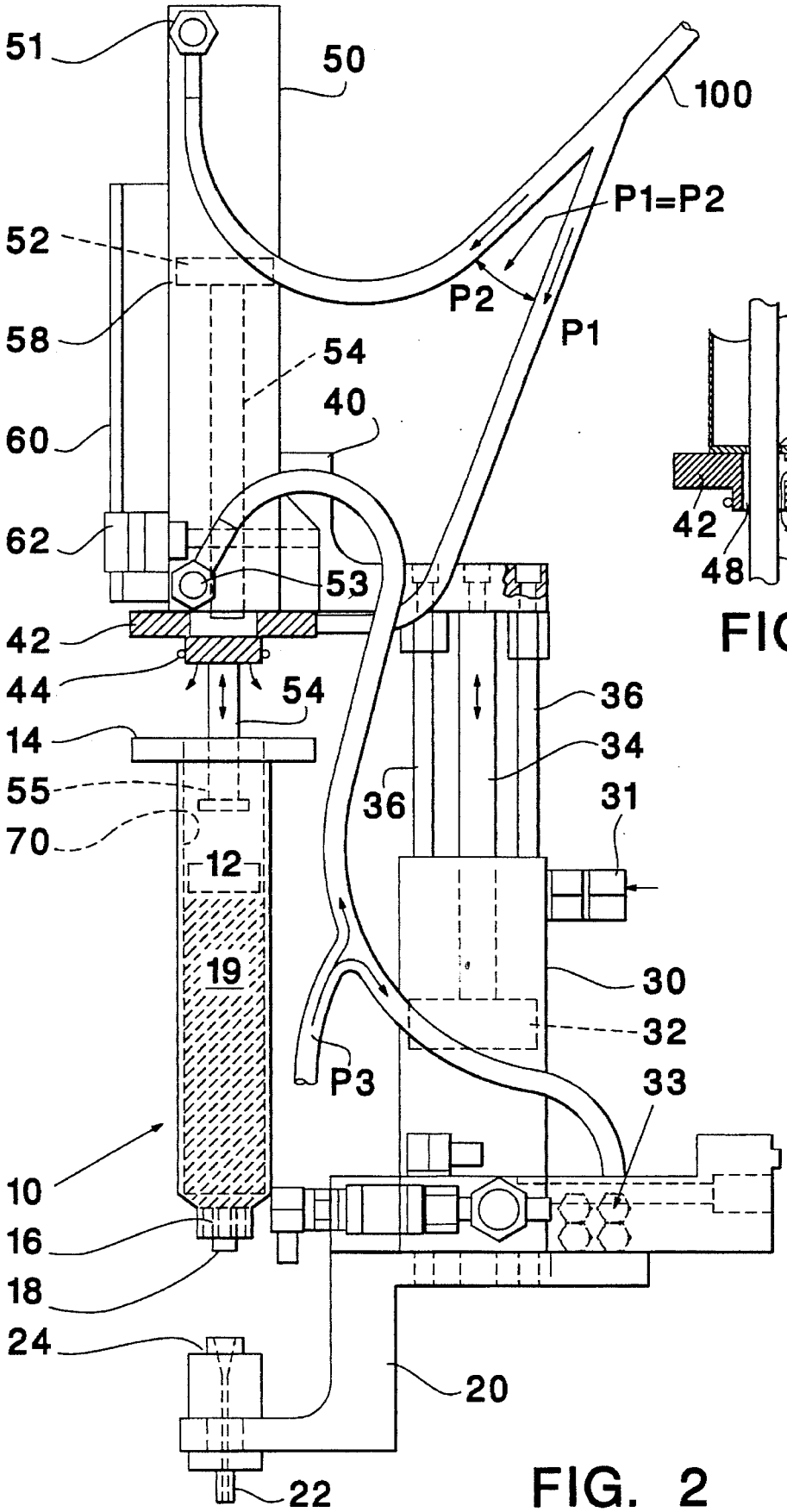
FIG. 2 is a side view, in partial cross section, of the device in its open position with a syringe being positioned for mounting therein.
Figure 3:
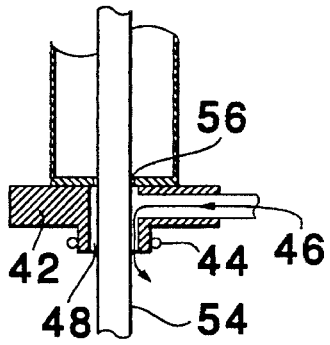
FIG. 3 is a cross sectional view of the syringe cover.

Referring to FIGS. 1–3 of the drawings, the Luer lock 16 on the proximal end of an adhesive supply syringe 10 is placed into the tapered end of the receiver 24 of lower bracket 20 for supplying adhesive, via outlet 18, to dispensing nozzle 22 of the dispensing station. Lower bracket 20 supports a clamping cylinder 30 as well as upper bracket 40 which, in turn, supports a cover 42 for syringe 10.

Upon actuating toggle switch 94 pressurized air is applied to fitting 31 of the clamping cylinder 30 and fitting 33 is opened to the ambient, piston 32 is actuated to retract rod 34 into the cylinder and, thus, to draw down the upper bracket 40 to clamp the syringe 10 between the upper and lower brackets 20 and 40. During this clamping, a cylindrical portion of cover 42 (FIG. 3) engages the inner bore 70 of syringe 10 and O-ring 44 provides an air-tight seal with inner bore 70 on the distal end of syringe 10 adjacent flange 14 and the Luer lock 16 is forced into the taper of receiver 24 providing a seal to prevent the loss of adhesive 19.

Referring to FIG. 3, the cover 42 has a lateral air inlet 46 communicating with centrally disposed opening 48 for purposes of supplying pressurized air directly to the plunger 12, via the distal end of syringe 10, once the air-tight seal is established.

In order to replenish adhesive for the dispensing station, the attendant reverses toggle switch 94 (FIG. 1), whereupon the clamping pressure is relieved by raising upper bracket 40 and the empty syringe 10 is easily removed without further turning or twisting from receiver 24 of lower bracket 20. Then, while holding a full replacement syringe 10 in the receiver 24, toggle switch 94 is reversed again so as to clamp the replacement syringe 10.

Thus, the need for threaded or bayonet-like connections and the inherent difficulties associated with them are obviated when connecting a syringe to a dispensing nozzle.

A preferred embodiment of the invention also includes an air cylinder 50 mounted on the upper bracket 50 of the clamping assembly. The piston rod 54 of cylinder 40 extends and maintains engagement with the syringe plunger 12, under air pressure applied to fitting 51 of cylinder 50, so as to "follow" plunger 12 as it is displaced by the pressurized air applied directly to plunger 12 via lateral opening 46 of cover 42. The pressurized air for driving the piston 52 of "follower" cylinder 50 can be supplied in air line 100 from the same pressurized source as, and simultaneously with, air applied through cover openings 46 and 48 to drive plunger 12 of the syringe 10. As seen in FIG. 2, Y-branching of air line 100 provides for this. As seen best in FIG. 3, piston (follower) rod 54 extends slidably through cover 42 and an O-ring 56 prevents air transfer between cylinder 50 and cover 42.

Tilting of the plunger 12 that could result in detrimental aeration of the adhesive, is counteracted by the follower 54. The plunger-engaging end 55 of follower 54 is configured to mate with plunger 12 so as to provide opposition to tilting of plunger 12.

It is contemplated also that follower 54 could be used in augmenting the driving force applied to the plunger 12. For instance, the force with which follower 54 and end 55 is kept in contact with the plunger 12 can be sufficient to supplement the plunger-driving force supplied by the air pressure that is applied directly to the distal side of the plunger 12. Thus, the pressure applied to plunger 12 via follower 54 and end 55 can cause an increase to the driving force experienced by plunger 12 over that only provided by direct air pressure on plunger 12.

In order that the attendant can monitor the adhesive supply during the dispensing operation, plate 60 is mounted on the outside of cylinder 50 to support a device for sensing the position of a magnet 58 which is mounted on piston 52. For instance, sensing device 62 is adjustably positioned to a location along the length of mounting plate 60 at which it will be actuated (opened or closed) by magnet 58. Thus, as the follower 54 attached to piston 52 follows plunger 12 of syringe 10 down to its empty position and by properly positioning the sensing device 62, an empty state of the syringe 10 is detectable by magnet 58 on piston 52 reaching a position directly opposite sensing device 62 (through the cylindrical wall of the syringe).

Also, it is contemplated that more elaborate indication of the amount of adhesive in the syringe could be implemented by detecting or otherwise indicating some or all positions of the piston 52, and hence the follower 54, during displacement thereof.

Thus, it will be seen that the objects set forth above, among those made apparent from the preceding description, are efficiently attained and since certain changes may be made in the construction set forth without departing from the scope of the invention, it is intended that all matter contained in the above description or shown in the accompanying drawings shall be interpreted as illustrative and not in a limiting sense.

It is to be understood also that the following claims are intended to cover all of the generic and specific features of the invention herein described, and all statements or the scope of the invention which, as a matter of language, might be said to fall therebetween.

We claim:

1. In a fluid dispenser for displacing a plunger of a syringe in order to discharge dots of fluid individually therefrom, the improvement comprising:

means for applying pressure on a distal end of said syringe and mating a proximal end of said syringe to a receiver portion of said dispenser;

means for closing a distal portion of said syringe while effecting said mating;

means for applying air under pressure directly to said plunger, via said closing means, as a displacing force on said plunger; and follower means for following displacement and maintaining engagement with said plunger and comprising a follower rod having a distal end protruding from said closing means.

2. The improvement as in claim 1, and said follower means further comprising:

means for detecting a low condition of fluid remaining in said syringe.

3. The improvement as in claim 1, and further comprising:

sensing means for changing state in response to a low condition of fluid remaining in said syringe; and magnet means, attached to said follower means, for displacing in concert with said plunger and causing said changing of state of said sensing means.

4. The improvement as in claim 1, and said follower means further comprising:

supplementing means for supplementing said displacing force of said directly applied air pressure by applying a supplemental displacing force to said plunger via said follower.

5. The improvement as in claim 4, wherein said supplementing means comprises:

a fluid cylinder means having a piston attached to said follower and moved by fluid supplied under pressure to said fluid cylinder means.

6. The improvement as in claim 1, wherein said distal end of said syringe has a flange, and further comprising:

said closing means being integral with said pressure, applying means and having means for providing an air-tight seal with said flange during clamping of said syringe; and said air applying means comprising an inlet to and through said closing means when said syringe is clamped for dispensing of adhesive therefrom.

7. The improvement as in claim 1, and said follower means further comprising:

means for preventing tilting of said plunger about a longitudinal axis of said syringe.

* * * * *